US011629467B2

(12) United States Patent
Vallieres

(10) Patent No.: US 11,629,467 B2
(45) Date of Patent: Apr. 18, 2023

(54) ICE REMOVAL BLADE ASSEMBLY FOR A VEHICLE

(71) Applicant: 9251-7747 QUEBEC INC, St-Christophe d'Arthabaska (CA)

(72) Inventor: Benoit Vallieres, St Christophe d'Arthabaska (CA)

(73) Assignee: 9251-7747 QUEBEC INC., Saint-Christophe-d'Arthabaska (CA)

( * ) Notice: Subject to any disclaimer, the term of this patent is extended or adjusted under 35 U.S.C. 154(b) by 225 days.

(21) Appl. No.: 17/105,601

(22) Filed: Nov. 26, 2020

(65) Prior Publication Data

US 2021/0156099 A1 May 27, 2021

Related U.S. Application Data

(60) Provisional application No. 62/940,392, filed on Nov. 26, 2019.

(51) Int. Cl.
*E01H 5/06* (2006.01)
*E01H 5/12* (2006.01)

(52) U.S. Cl.
CPC ..... *E01H 5/061* (2013.01); *E01H 5/12* (2013.01)

(58) Field of Classification Search
CPC ..... E01H 5/061; E01H 5/12; E01H 5/066; E01H 5/065
See application file for complete search history.

(56) References Cited

U.S. PATENT DOCUMENTS 2,440,905 A * 5/1948 Maxim ..... E01H 5/063 37/270
4,307,523 A * 12/1981 Reissinger ..... E01H 5/06 37/232
4,607,781 A * 8/1986 Shwayder ..... B23K 31/02 228/175
5,697,172 A * 12/1997 Verseef ..... E01H 5/062 172/264
6,701,646 B2 * 3/2004 Schultz ..... E01H 5/063 37/232
8,191,287 B2 * 6/2012 Winter ..... E01H 5/061 37/266
8,984,778 B2 * 3/2015 Fox ..... E01H 5/062 37/266
9,611,604 B2 * 4/2017 Vigneault ..... E01H 5/063
10,865,534 B2 * 12/2020 Martin ..... E01H 5/066

(Continued)

*Primary Examiner* — Jamie L McGowan
(74) *Attorney, Agent, or Firm* — BCF LLP

(57) ABSTRACT

An ice removal blade assembly for a vehicle includes: a support member configured to be affixed to a snow plow of the vehicle; a suspension member pivotably connected to the support member, the suspension member being pivotable about a suspension pivot axis; a plurality of blade mounts pivotably connected to the suspension member, the blade mounts being laterally spaced from one another, each blade mount of the plurality of blade mounts being pivotable about a respective blade mount pivot axis, the blade mount pivot axes of the blade mounts extending generally parallel to the suspension pivot axis; and a plurality of removable blade members affixed to respective ones of the blade mounts so as to pivot together therewith about the blade pivot axes. Each removable blade member has a lower cutting edge configured to scrape ice on a ground surface on which the vehicle travels.

14 Claims, 7 Drawing Sheets

(56) References Cited

U.S. PATENT DOCUMENTS

| | | | | |
|---|---|---|---|---|
| 11,326,316 | B1 * | 5/2022 | Condello | E01H 5/066 |
| 2009/0223090 | A1 * | 9/2009 | Hunt | E01H 5/061 37/266 |
| 2012/0260537 | A1 * | 10/2012 | Winter | E01H 5/061 37/270 |
| 2013/0174452 | A1 * | 7/2013 | Diehl | E01H 5/063 37/233 |
| 2013/0239352 | A1 * | 9/2013 | Bergeron | E01H 5/061 15/245 |
| 2015/0376850 | A1 * | 12/2015 | Giletta | E01H 5/063 37/233 |
| 2017/0009416 | A1 * | 1/2017 | Winter | E01H 5/061 |
| 2017/0191236 | A1 * | 7/2017 | Winter | E02F 9/26 |
| 2017/0218585 | A1 * | 8/2017 | Vigneault | E01H 5/062 |
| 2018/0327989 | A1 * | 11/2018 | Stephan | E01H 5/062 |
| 2019/0063021 | A1 * | 2/2019 | Hayes | E01H 5/062 |
| 2019/0136473 | A1 * | 5/2019 | Desrochers | E01H 5/066 |
| 2019/0136474 | A1 * | 5/2019 | Martin | E01H 5/062 |
| 2019/0203436 | A1 * | 7/2019 | Martin | E01H 5/066 |
| 2019/0276999 | A1 * | 9/2019 | Holman | E01H 5/062 |
| 2021/0156099 | A1 * | 5/2021 | Vallieres | E01H 5/12 |
| 2022/0010512 | A1 * | 1/2022 | Duchesneau | E01H 5/067 |
| 2022/0243411 | A1 * | 8/2022 | Vigneault | E01H 5/062 |

* cited by examiner

ICE REMOVAL BLADE ASSEMBLY FOR A VEHICLE

CROSS REFERENCE

The present application claims priority from U.S. Provisional Patent Application No. 62/940,392, filed on Nov. 26, 2019, the entirety of which is incorporated by reference herein.

FIELD OF THE TECHNOLOGY

The present disclosure generally relates to road maintenance accessories, in particular to ice removal blade assemblies for a vehicle.

BACKGROUND

During winter, in many northern countries, municipalities must clear the roads of accumulated snow to ensure safe driving conditions. To do this, various types of snow removal vehicles (e.g., trucks, tractors, etc.) equipped with snow plows are deployed. However, snow removal vehicles can face various difficulties in performing their snow clearing task. Notably, the surface of a road is often made uneven by ice formed thereon, on top of the fact that the road may be deteriorated and thus uneven to begin with. For example, in some cases, snow removal vehicles can cling to the ice covering the roads which can cause the snow removal vehicle to undergo impact shocks. This can make the ride unpleasant for the operator of the snow removal vehicle and moreover it can slow down the vehicle, therefore slowing down the snow removal process.

In addition, to reduce slippery conditions caused by the formation of ice on the roads, salt or sand is often spread on the roads, which results in increased costs for the maintenance of the road.

Therefore, there is a need for snow removal vehicles adapted to overcome or reduce at least some of the above-described problems.

SUMMARY

According to an aspect of the present technology, there is provided an ice removal blade assembly for a vehicle. The ice removal blade assembly includes: a support member configured to be affixed to a snow plow of the vehicle; a suspension member pivotably connected to the support member, the suspension member being pivotable about a suspension pivot axis; a plurality of blade mounts pivotably connected to the suspension member, the blade mounts being laterally spaced from one another, each blade mount of the plurality of blade mounts being pivotable about a respective blade mount pivot axis, the blade mount pivot axes of the blade mounts extending generally parallel to the suspension pivot axis; and a plurality of removable blade members affixed to respective ones of the blade mounts so as to pivot together therewith about the blade pivot axes, each removable blade member of the plurality of removable blade members having a lower cutting edge configured to scrape ice on a ground surface on which the vehicle travels.

In some embodiments, the suspension member is movable generally vertically relative to the support member so that the suspension pivot axis is movable generally vertically.

In some embodiments, the suspension member defines a slot extending generally vertically; and the suspension member has a pivot displaceable along the slot of the support member.

In some embodiments, the ice removal blade assembly also includes a suspension limiter connected to the support member, the suspension limiter being configured to limit pivoting of the suspension member relative to the support member.

In some embodiments, the suspension limiter is connected to an upper portion of the support member.

In some embodiments, the suspension limiter has a first lateral end and a second lateral end; and the first and second lateral ends are positioned to abut the suspension member to limit pivoting of the suspension member relative to the support member in both rotation directions about the suspension pivot axis.

In some embodiments, the suspension limiter is a leaf spring.

In some embodiments, the suspension member includes a plurality of abutments projecting outwardly from an outer surface of the suspension member, the abutments being positioned to limit pivoting of each blade mount about the respective blade mount pivot axis.

In some embodiments, for each blade mount of the plurality of blade mounts, two of the abutments are positioned to limit pivoting of the blade mount.

In some embodiments, each blade mount of the plurality of blade mounts is generally rectangular.

In some embodiments, a snow removal vehicle includes: a snow plow and the ice removal blade assembly. The ice removal blade assembly is affixed to the snow plow.

According to another aspect of the present technology, there is provided an ice removal blade assembly for affixing to a snow plow of a vehicle. The ice removal blade assembly includes: a suspension member configured to be operatively and movably connected to the snow plow of the vehicle; and a plurality of removable blade members operatively connected to the suspension member, each removable blade member of the plurality of removable blade members having a lower cutting edge configured to scrape ice on a ground surface on which the vehicle travels. Each removable blade member of the plurality of removable blade members is: pivotable relative to the suspension member about a respective blade pivot axis and movable together with the suspension member relative to the snow plow of the vehicle.

In some embodiments, the suspension member is configured to be pivotable relative to the snow plow of the vehicle about a suspension pivot axis extending generally parallel to the blade pivot axes. Each removable blade member of the plurality of removable blade members is pivotable together with the suspension member about the suspension pivot axis.

In some embodiments, the suspension member is configured to be translated generally vertically relative to the snow plow of the vehicle. Each removal blade member of the plurality of removable blade members is translated together with the suspension member generally vertically relative to the snow plow of the vehicle.

In some embodiments, the ice removal blade assembly also includes a support member configured to be affixed to the snow plow of the vehicle. The suspension member is movably connected to the support member.

In some embodiments, the ice removal blade assembly also includes a plurality of blade mounts pivotably connected to the suspension member. The blade mounts are laterally spaced from one another. Each blade mount of the plurality of blade mounts is pivotable about a respective one of the blade pivot axes. Each removable blade member is removably connected to a respective one of the blade mounts to pivot relative to the suspension member.

For purposes of this application, terms related to spatial orientation such as forwardly, rearward, upwardly, downwardly, left, and right, are as they would normally be understood by an operator of the snow removal vehicle in a normal driving position. Terms related to spatial orientation when describing or referring to components or sub-assemblies of the vehicle, separately from the vehicle, should be understood as they would be understood when these components or sub-assemblies are mounted to the vehicle, unless specified otherwise in this application.

Other aspects and features of the present disclosure will become apparent to those ordinarily skilled in the art upon review of the following description of some of the embodiments.

BRIEF DESCRIPTION OF THE DRAWINGS

Further aspects and advantages of the present technology will become better understood with reference to the description in association with the following in which.

Figure 1:
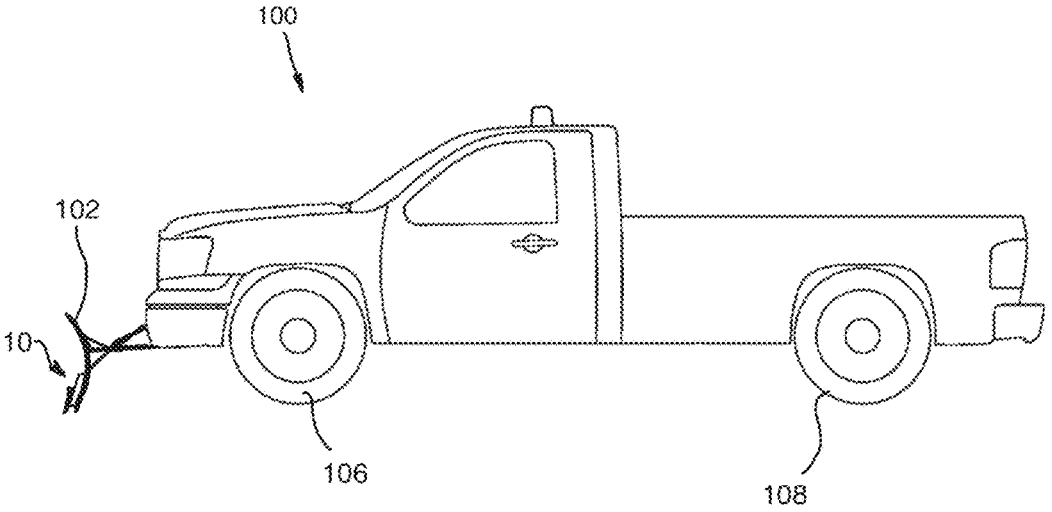
FIG. 1 is a left side elevation view of an example of a snow removal vehicle having a snow plow equipped with an ice removal blade assembly according to an embodiment of the present technology.

It is to be expressly understood that the description and drawings are only for the purpose of illustrating certain embodiments of the present disclosure and are an aid for understanding. They are not intended to be a definition of the limits of the disclosure and/or of the technology.

DETAILED DESCRIPTION

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example "A and/or B" is to be taken as specific disclosure of each of (i) A, (ii) B and (iii) A and B, just as if each is set out individually herein.

With reference to FIG. 1, a snow removal vehicle 100 having a snow plow 102 is shown. The snow plow 102 is an implement used for pushing snow so as to clear snow from different surfaces, such as roads for example. Notably, the snow plow 102 has an outer surface 104 facing away from a frame (not shown) of the snow removal vehicle 100. The snow plow 102 is sometimes alternatively referred to as a "shovel". As can be seen, an ice removal blade assembly 10 in accordance with an embodiment of the present technology is connected to the snow plow 102 of the vehicle 100. As will be described in detail below, the ice removal blade assembly 10 is configured to scrape ice from surfaces, such as roads, on which the snow removal vehicle 100 travels.

As shown in FIG. 1, in this embodiment, the snow removal vehicle 100 is a pick-up truck having front and rear wheels 106, 108. Nevertheless, it is contemplated that the snow removal vehicle 100 could be any other suitable type of snow removal vehicle in other embodiments. For example, the snow removal vehicle 100 could be a tool vehicle, a tractor, a truck, a snowblower, and a passenger vehicle amongst others. As such, the snow removal vehicle 100 may not necessarily be a wheeled vehicle, and may instead be a tracked vehicle for example (i.e., having ground-engaging tracks).

Figure 2:
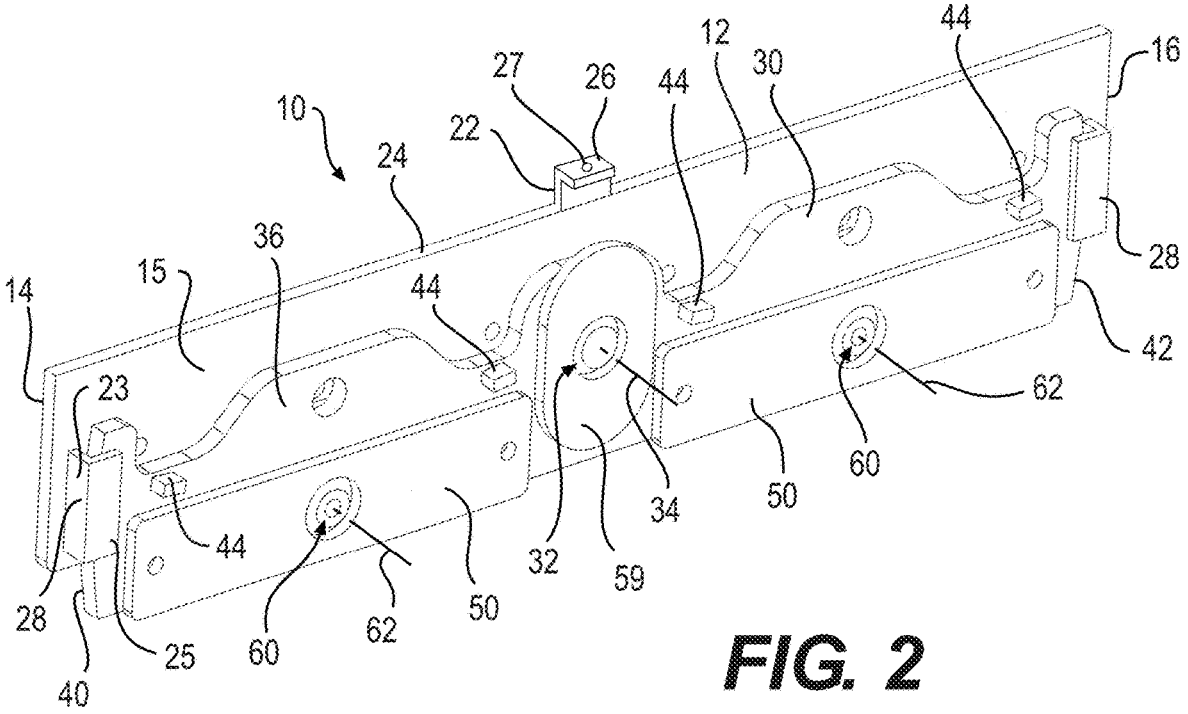
FIG. 2 is a perspective view, taken from a front, right side, of part of the ice removal blade assembly of FIG. 1.
Figure 3:
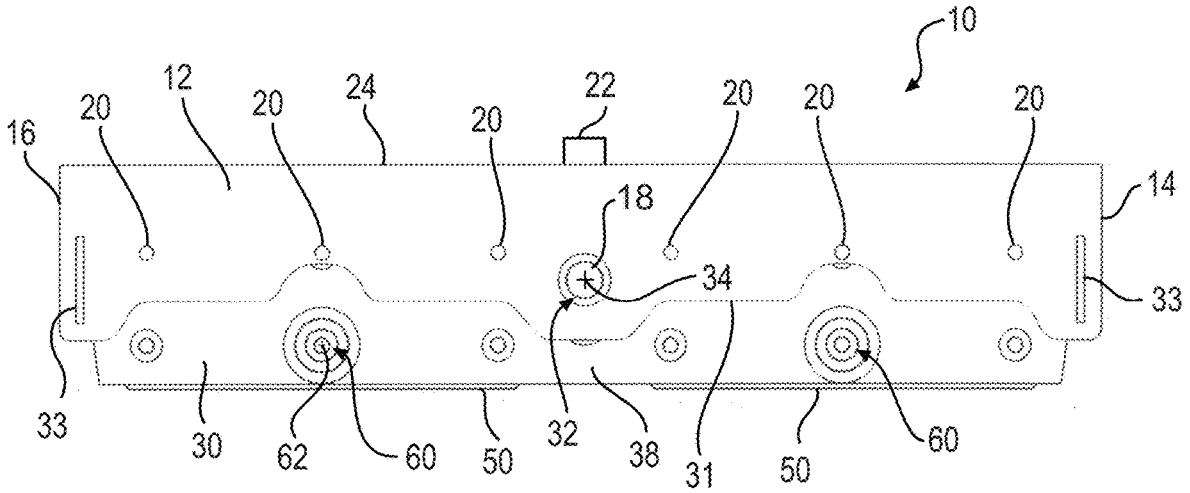
FIG. 3 is a rear elevation view of the part of the ice removal blade assembly of FIG. 2.
Figure 4:
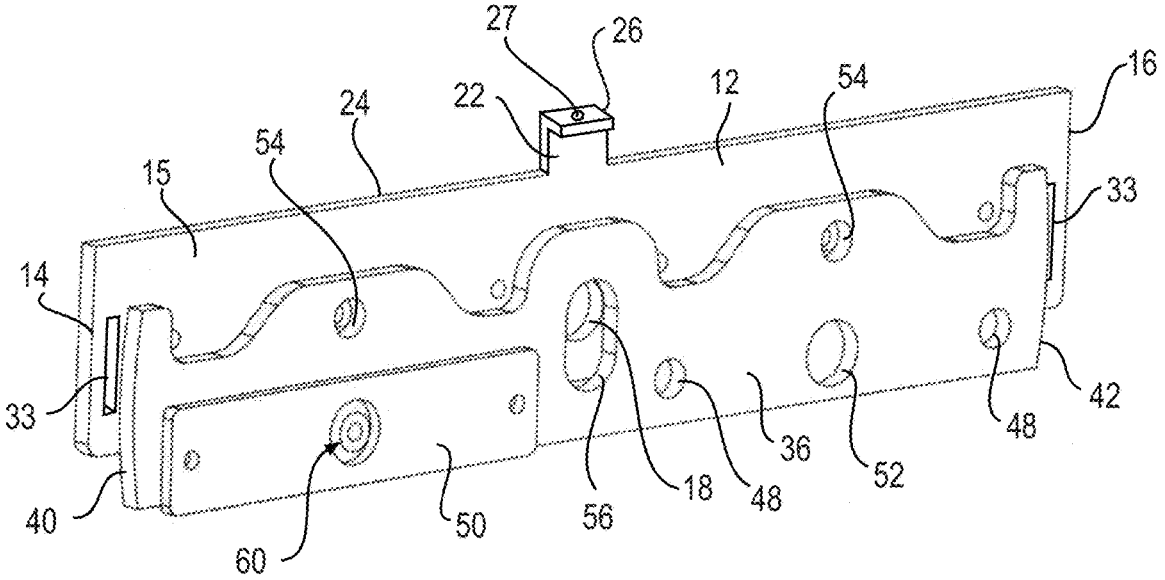
FIG. 4 is a perspective view, taken from a front, right side, of the part of the ice removal blade assembly of FIG. 2, with one blade mount of removed therefrom for clarity to expose the components behind it.

With reference to FIGS. 2 to 4, the ice removal blade assembly 10 includes a support member 12 which is configured to support and interconnect the other components of the ice removal blade assembly 10 to the snow plow 102. Notably, as shown in greater detail in FIGS. 3 and 4, the support member 12 extends laterally from one lateral end 14 to an opposite lateral end 16, defining a width of the support member 12 therebetween. The support member 102 defines a plurality of openings, including a central opening 18 (centered between the lateral ends 14, 16) and a set of openings 20 that are vertically aligned with one another. The central opening 18 has a greater diameter than the openings 20. As will be described in more detail below, the central opening 18 is configured for mounting a suspension member to the support member 12.

The support member 12 has an upper bracket 22 located at an upper end 24 of the support member 12. The upper bracket 22 includes a forwardly-extending portion 26 that extends generally horizontally. The upper bracket 22 is configured to accommodate the connection of a suspension limiting member thereto, as will be described in greater detail below.

The support member 12 also has two suspension guides 28 extending forwardly from an outer surface 15 of the support member 12 (i.e., the surface that faces away from the frame of the vehicle 100). As shown in FIG. 2, each suspension guide 28 is disposed near a corresponding one of the lateral ends 14, 16 of the support member 12. The suspension guides 28 are configured to guide a suspension member, which will be described in more detail below, as it moves relative to the support member 12. In this embodiment, each suspension guide 28 is generally L-shaped and has a transverse portion 23 that extends generally perpendicular to the outer surface 15 of the support member 12, and a laterally-extending portion 25 which extends generally laterally and thus parallel to the outer surface 15 of the support member 12. The laterally-extending portion 25 of each suspension guide 28 extends laterally toward a center of the support member 12 (i.e., toward a midpoint of the width of the support member 12).

In this embodiment, the suspension guides 28 are welded to the main body of the support member 12 (i.e., the portion of support member 12 which defines the lateral ends 14, 16). To that end, as shown in FIG. 3, the support member 12 defines openings 33 which partly receive the suspension guides 28 therein. The suspension guides 28 may be affixed to the main body of the support member 12 in any other suitable way in other embodiments.

As shown in FIG. 3, a lower end 31 of the support member 12 has a particular shape. Notably, the lower end 31 is recessed at various portions thereof.

Figure 10:
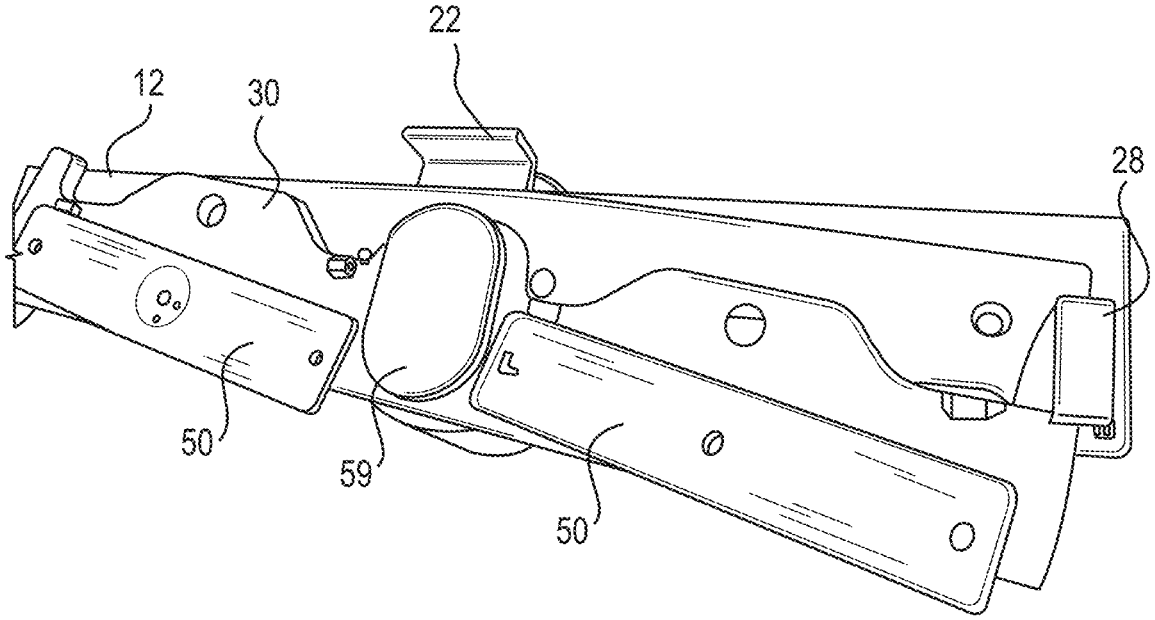
FIG. 10 is a perspective view, taken from the front, of part of the ice removal blade assembly of FIG. 2, showing the suspension member and the blade mounts of the ice removal blade assembly in a pivoting condition, with the suspension member being in a different vertical position than in FIG. 9.

Returning to FIG. 2, a suspension member 30 of the ice removal blade assembly 10 is movably connected to the support member 12. The suspension member 30 has various degrees of freedom of movement relative to the support member 12. In particular, in this embodiment, the suspension member 30 is pivotably connected to the support member 12 by a pivot 32 of the suspension member 30 which defines a suspension pivot axis 34 that extends in a direction normal to the outer surfaces 15, 36 of the support member 102 and the suspension member 30. As such, the suspension member 30 is pivotable about the suspension pivot axis 34 of the pivot 32. In other words, as shown for example in FIG. 10, the suspension member 30 can pivot leftwardly and rightwardly about the pivot axis 34. The pivot 32 is connected to the support member 12 via the central opening 18 defined by the support member 12. As shown in FIG. 2, a cover member 59 covers the pivot 32 on an outer side thereof. The cover member 59 is connected to the suspension member 30. In this embodiment, the cover member 59 is generally oval and covers the slot 56.

Figure 8:
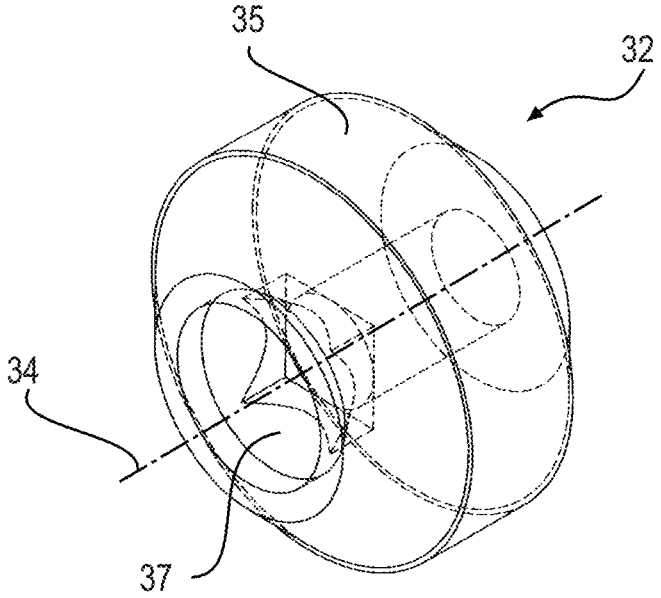
FIG. 8 is a perspective view of a pivot of the ice removal blade assembly of FIG. 2.

As shown in FIG. 8, in this embodiment, the pivot 32 has a cylindrical body 35 defining a central opening 37 extending therethrough. The central opening 37 defines the pivot axis 34. The central opening 37 is counterbored to accommodate the head of a fastener (not shown) which is used to connect the pivot 32 to the suspension member 30 and the support member 12.

In this embodiment, in addition to being pivotable relative to the support member 12, the suspension member 30 is also movable generally vertically relative to the support member 12 such that the pivot axis 34 itself is movable generally vertically relative to the support member 12 (i.e., it is not only a vertical movement due to the pivoting of the suspension member 30 relative to the support member 12). As will be described in more detail below, this vertical movement of the suspension member 30 relative to the support member 12 (and thus relative to the snow plow 102) may allow an even greater amount of conformity to the shape of the ground surface on which the vehicle 100 travels which can make operation of the vehicle 100 smoother and more efficient.

It is contemplated that, in some embodiments, the ice removal blade assembly 10 may omit the support member 12 and that the suspension member 30 could instead be movably connected directly to the snow plow 102. Notably, modifications could be made to the snow plow 102 to have some of the supporting structures that are provided by the support member 12 to allow the suspension member 30 to be connected directly thereto.

Figure 5:
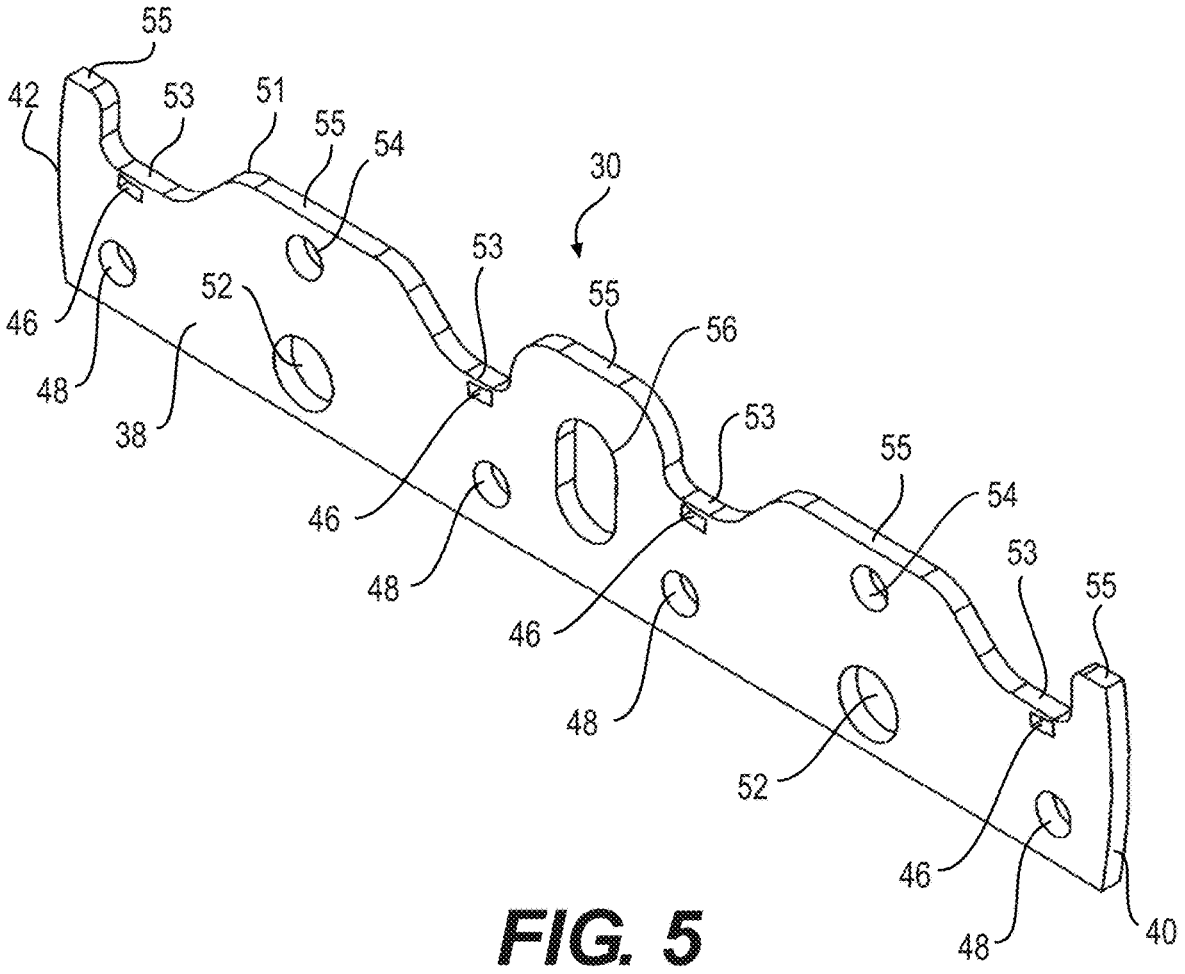
FIG. 5 is a perspective view, taken from a rear, right side, of a suspension member of the ice removal blade assembly of FIG. 2.

As shown in FIG. 5, the suspension member 30 is generally planar (i.e., plate-like), with its thickness being defined between an outer surface 36 (FIG. 4) and an inner surface 38 of the suspension member 30. The outer surface 36 faces away from the support member 12 when the suspension member 30 is connected thereto. The suspension member 30 extends from one lateral end 40 to an opposite lateral end 42. In this embodiment, the lateral ends 40, 42 are generally curved about an axis of curvature that extends normal to the outer surface 36 of the suspension member 30. This may help the lateral ends 40, 42 clear the suspension guides 28 when the suspension member 30 pivots about the pivot axis 34.

As shown in FIG. 2, the suspension member 30 also has a plurality of abutments 44 projecting outwardly (i.e., forwardly) from the outer surface 36. The abutments 44 are positioned to limit pivoting of blade mounts of the ice removal blade assembly 10, which will be described in detail below. In this embodiment, the abutments 44 are welded to a main body of the suspension member 30. To that end, as shown in FIG. 5, the main body of the suspension member 30 defines a plurality of openings 46 for partially inserting the abutments 44 therein for welding to the main body of the suspension member 30.

Figure 6:
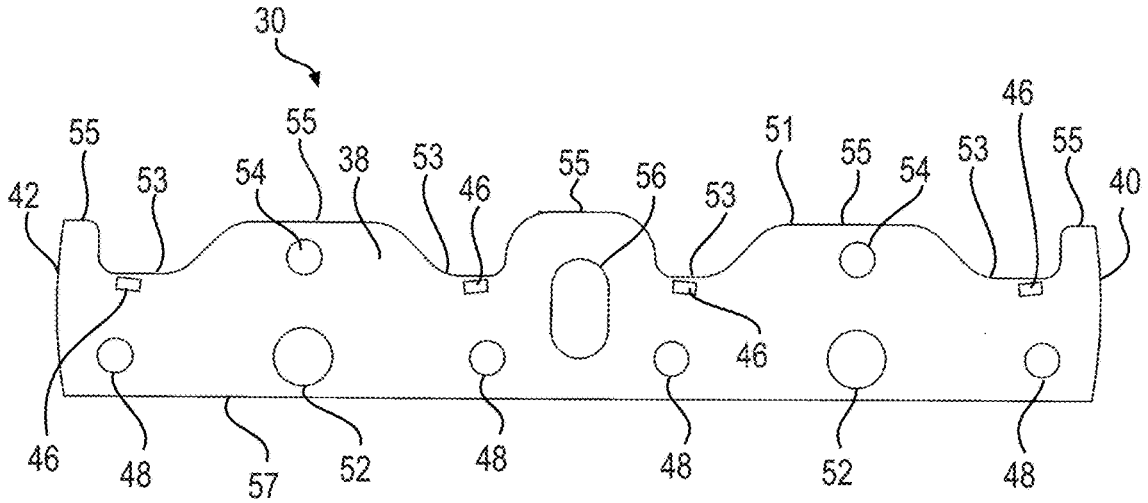
FIG. 6 is a rear elevation view of the suspension member of FIG. 5.

With continued reference to FIGS. 5 and 6, the suspension member 30 defines a plurality of openings 48 which are aligned vertically with one another. The suspension member 30 also defines a plurality of openings 52 which are vertically aligned with the openings 48 (i.e., their respective axes are at the same vertical height on the suspension member 30). The openings 52 are provided for connecting the blade mounts to the suspension member 30, as will be described in greater detail below.

The suspension member 30 also defines two openings 54 near an upper end 51 of the suspension member 30.

As shown in FIGS. 5 and 6, the suspension member 30 also defines a central aperture 56 in order to allow the vertical movement of the suspension member 30 relative to the support member 12. The central aperture 56 is a slot extending generally vertically. During use, the pivot 32 is fixed in position on the support member 12 but travels vertically within the slot 56. As can be seen in FIG. 4, the slot 56 is aligned with the central opening 18 of the support member 56. The pivot 32 stays fixed within the central opening 18 but is movable within the slot 56.

As can be seen in FIG. 6, the upper end 51 of the suspension member 30 has a particular shape. Notably, the upper end 51 has recessed portions 53 and upward-extending portions 55 which extend vertically higher than the recessed portions 53. On the other hand, the lower end 57 of the suspension member 30 is rectilinear.

Figure 9:
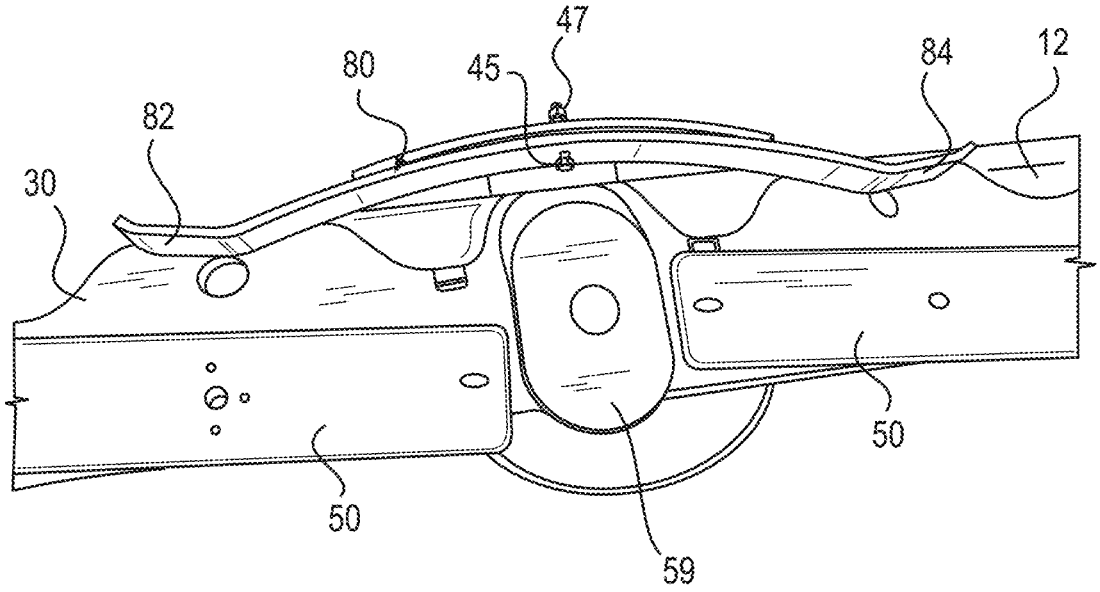
FIG. 9 is a perspective view, taken from the front, of part of the ice removal blade assembly of FIG. 2, showing the blade mounts of the ice removal blade assembly in a pivoting condition.

As briefly mentioned above, the ice removal blade assembly 10 also has a suspension limiter 80 which is configured to limit pivoting of the suspension member 30 relative to the support member 12 about the suspension pivot axis 34. In this embodiment, as shown in FIG. 9, the suspension limiter 80 is connected to an upper portion of the support member 12. In particular, the suspension limiter 80 is connected to the upper bracket 22 of the support member 12 by a fastener 45 (e.g., a bolt) which extends through the suspension limiter 80 and through an opening 27 defined by the forwardly-extending portion 26 of the upper bracket 22. A fastener 47 (e.g., a nut) retains the fastener 45 in place. In this embodiment, the suspension limiter 80 has two lateral ends 82, 84 which are positioned to abut the suspension member 30 to limit pivoting of the suspension member 30 relative to the support member 12 in both rotation directions about the suspension pivot axis 34. Notably, in this embodiment, the suspension limiter 80 is a leaf spring having a given spring constant. As such, the suspension limiter 80 does not abruptly stop the pivoting motion of the suspension member 30 about the pivot axis 34 when the suspension member 30 abuts one of the ends 82, 84 of the suspension limiter 80, but instead elastically deforms under the force applies thereto by the suspension member 30 and applies a counter force on the suspension member 30 to counter the pivoting motion of the suspension member 30. The resistance offered by the suspension limiter 80 gets progressively greater as the suspension limiter 80 continues elastically deforming under the force applied thereto by the suspension member 30.

It is contemplated that the suspension limiter 80 may be configured in any other suitable way in other embodiments.

With reference again to FIG. 2, the ice removal blade assembly 10 has a plurality of blade mounts 50 which are configured for affixing blade elements thereto. As can be seen, the blade mounts 50 are arranged in a tandem configuration (i.e., one next to the other) such that the blade mounts 50 are laterally spaced apart from one another. Each blade mount 50 is pivotably connected to the suspension member 30 via a pivot 60 defining a blade pivot axis 62 which extends generally parallel to the suspension pivot axis 34. Notably, each pivot 60 is connected to the suspension member 30 via the openings 52 defined by the suspension member 30. The blade mounts 50 are positioned such that their blade pivot axes 62 are generally vertically aligned with one another (i.e., a distance between the lower end 57 of the suspension member 30 and the blade pivot axes 62 is generally constant). The pivot 60 may be configured in any suitable way. In this embodiment, the pivot 60 has the same configuration as the pivot 32 described above.

Figure 7:
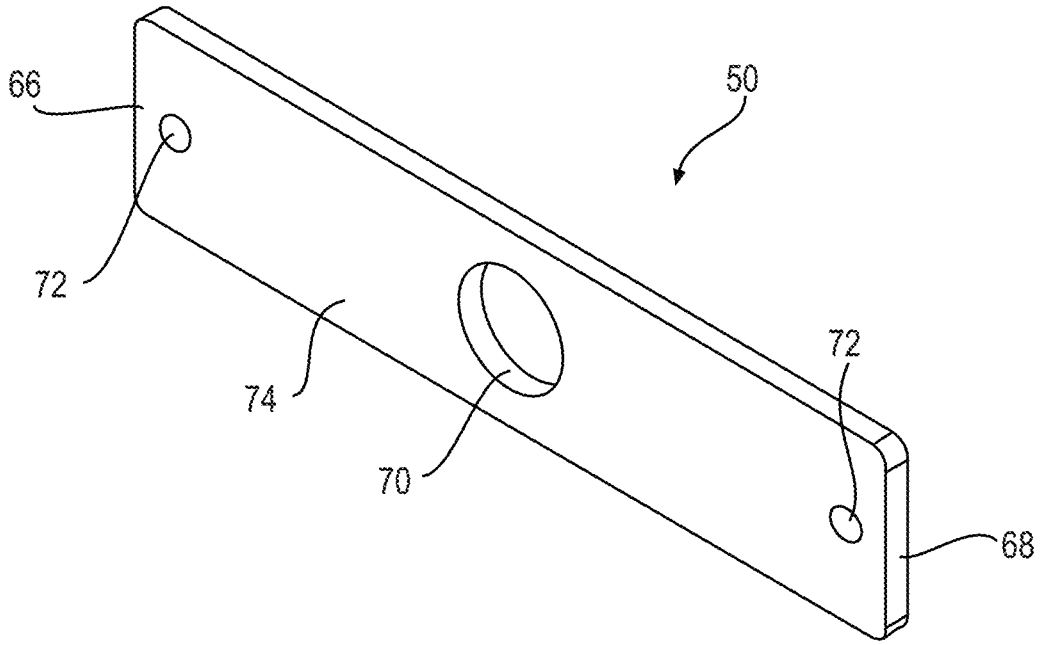
FIG. 7 is a perspective view, taken from a front, left side, of a blade mount of the ice removal blade assembly of FIG. 2.

As shown in FIG. 7, in this embodiment, each blade mount 50 is generally rectangular and extends from one lateral end 66 to an opposite lateral end 68. As can be seen, the blade mount 50 is generally planar (i.e., plate-like) and defines various openings extending from an outer surface 74 of the blade mount 50 to an inner surface (not shown), including a central opening 70 and two lateral openings 72. The central openings 70 has a greater diameter than the lateral openings 72. Notably, the central opening 70 is sized to accommodate the pivot 62 of the blade mount 50 as the pivot 62 is connected to the blade mount 50 via the central opening 70. The lateral openings 72 are configured for the connection of a blade member to the corresponding blade mount 50 as will be described in more detail below.

As will be understood, while in this embodiment two blade mounts 50 are provided such that the tandem configuration of the blade mounts 50 consists of two side-by-side blade mounts 50, it is contemplated that additional blade mounts 50 may be provided in other embodiments. For example, where the snow plow 102 of the vehicle 100 is of a greater width, the support member 12 and the suspension member 30 may be wider to accommodate additional blade mounts 50 so that the blade mounts 50 span a greater portion of the width of the snow plow 102.

Figure 11:
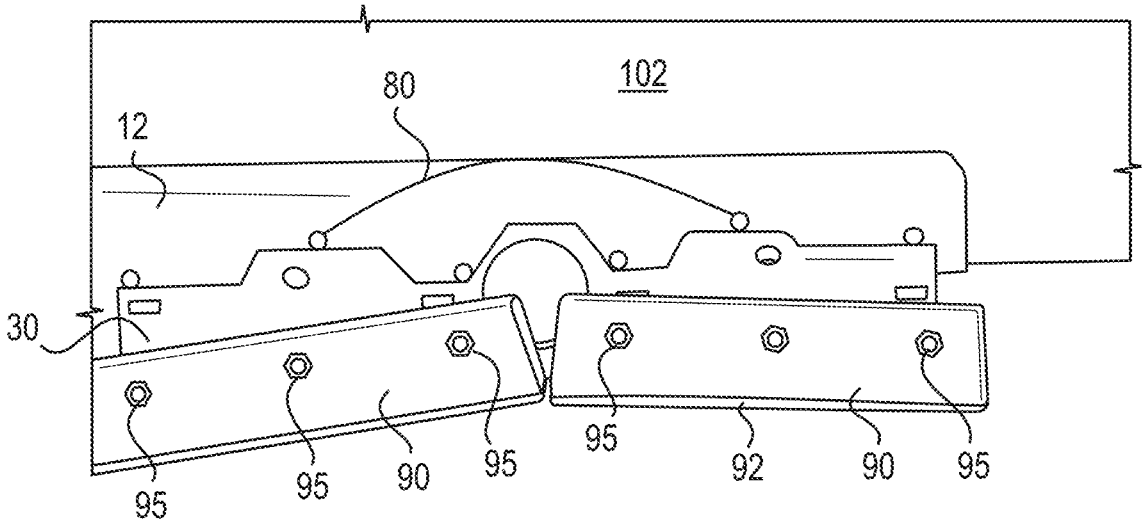
FIG. 11 is a perspective view, taken from the front, of the ice removal blade assembly of FIG. 2 as mounted to the snow plow of the snow removal vehicle.
Figure 12:
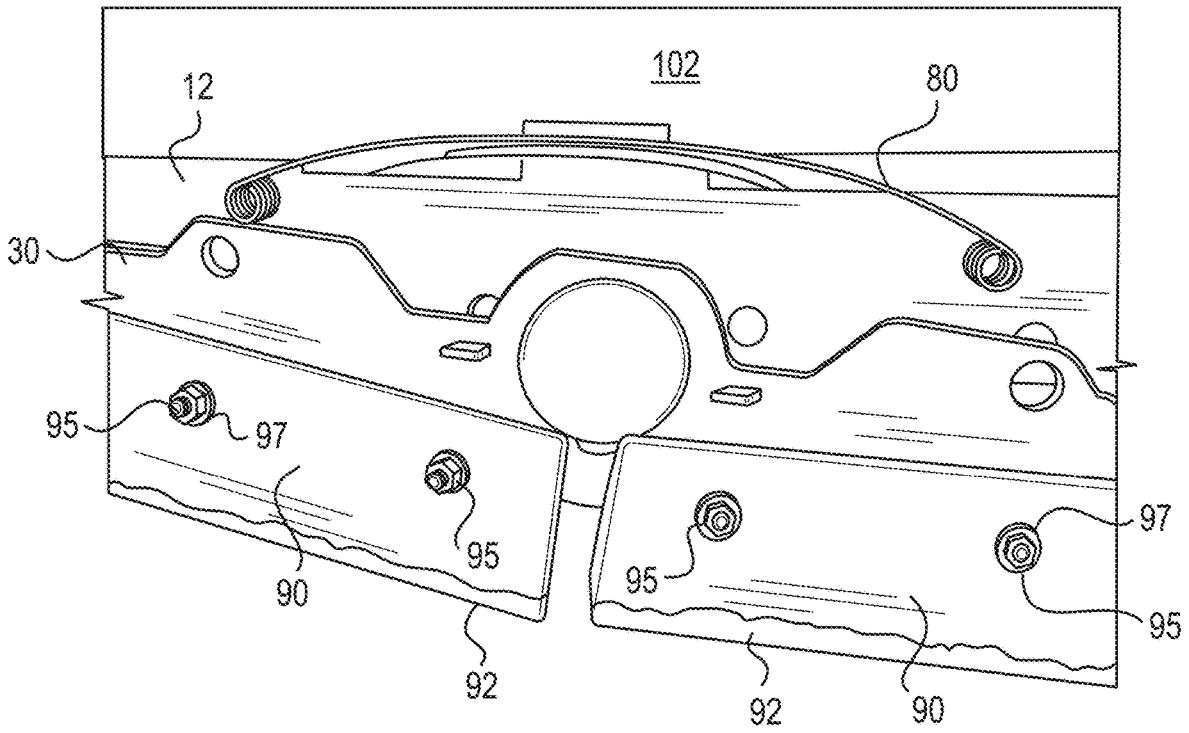
FIG. 12 is a perspective view, taken from the front, of part of the ice removal blade assembly of FIG. 11.

In this embodiment, the blade mounts 50 pivot about the blade pivot axes 64 but they are not provided with a cutting edge themselves. Rather, as shown in FIGS. 11 and 12, a plurality of blade members 90 are provided, with each blade member 90 being affixed to a respective one of the blade mounts 50. As such, each blade member 90 is pivotable together with the corresponding blade mount 50 about the corresponding blade pivot axis 64. As there are two blade mounts 50 in this embodiment, two blade members 90 are provided.

Each blade member 90 is generally rectangular and has a lower cutting edge 92 that is configured to scrape ice on the ground surface on which the vehicle 100 travels. The blade member 90 is sized to cover substantially the majority of the outer surface 74 of the corresponding blade mount 50. Each blade element 90 defines three openings (not shown) for receiving respective fasteners 95 (e.g., bolts) therein. Notably, the openings of the blade member 90 are provided in the same pattern as the openings 70, 72 of the blade mount 50. In particular, each fastener 95 extends through a given one of the openings 70, 72 of the blade mount 50 and through a corresponding opening of the blade member 90. Fasteners 97 (e.g., nuts) retain the fasteners 95 so as to secure the blade mounts 50 and the blade members 90 together. As will be understood, one of the fasteners 95 extends through the central opening 70 and thus forms part of the pivot 60 of the corresponding blade mount 50.

The blade members 90 extend along a majority of the width of the snow plow 102 of the vehicle 100 in order provide to the snow plow 102 with the ability to remove and scratch ice from the ground surface on which the vehicle 100 travels for a majority of the width of the snow plow 102. Furthermore, when the lower cutting edges 92 of the blade members 90 become dull from extended use, the blade members 90 are simply removed and replaced by new or resharpened blade members 90.

The blade members 90 may be configured differently in other embodiments. Moreover, it is contemplated that, in some embodiments, the blade mounts 50 may be omitted and the blade members 90 may be pivotably connected directly to the suspension member 30.

During use of the vehicle 100 provided with the ice removal blade assembly 10 on the snow plow 102, while the vehicle 100 drags the snow plow 102 near or on the road to push snow, the blade members 90 scratch any ice formed on the road so as to remove the ice therefrom. This may therefore provide the snow plow 102 with an additional functionality compared to conventional snow plows. For instance, in some cases, the snow plow 102 may thus even be used solely to scratch the ice formed on the roads (i.e., without pushing any snow).

Moreover, the above-described configuration of the ice removal blade assembly 10 allows the lower cutting edges 92 of the blade members 90 to adapt to the profile of the road in order remove ice efficiently. Notably, as the blade members 90 can pivot about the blade pivot axes 64 and the blade members 90 also move together with the suspension member 30, uneven road surfaces are easily adapted to by the ice removal blade assembly 10 which consequently can result in a reduction of wear and tear of the snow plow 102 as well as greater productivity as the vehicle 100 is not slowed down by the presence of ice in the same manner as conventional snow removal vehicles. Furthermore, as the blade members 90 move to adapt to profile of the road, the vehicle 100 may be less impacted by the jolts that are experienced by conventional snow plows when the snow plow gets caught on ice. In addition, due to the added ability of the snow plow 102 to remove ice, the use of salt and sand can be considerably reduced, thereby reducing the costs associated with road maintenance.

Variations and modifications will occur to those of skill in the art after reviewing this disclosure. The disclosed features may be implemented, in any combination and subcombinations (including multiple dependent combinations and subcombinations), with one or more other features described herein. The various features described or illustrated above, including any components thereof, may be combined or integrated in other systems. Moreover, certain features may be omitted or not implemented. Examples of changes, substitutions, and alterations are ascertainable by one skilled in the art and could be made without departing from the scope of the information disclosed herein.

It should be appreciated that the technology is not limited to the particular embodiments described and illustrated herein but includes all modifications and variations falling within the scope of the technology as defined in the appended claims.

The invention claimed is:

1. An ice removal blade assembly for a vehicle, comprising:
- a support member configured to be affixed to a snow plow of the vehicle;
- a suspension member pivotably connected to the support member, the suspension member being pivotable about a suspension pivot axis;
- a plurality of blade mounts pivotably connected to the suspension member, the blade mounts being laterally spaced from one another, each blade mount of the plurality of blade mounts being pivotable about a respective blade mount pivot axis, the blade mount pivot axes of the blade mounts extending generally parallel to the suspension pivot axis; and
- a plurality of removable blade members affixed to respective ones of the blade mounts so as to pivot together therewith about the blade pivot axes, each removable blade member of the plurality of removable blade members having a lower cutting edge configured to scrape ice on a ground surface on which the vehicle travels, wherein the suspension member comprises a plurality of abutments projecting outwardly from an outer surface of the suspension member, the abutments being positioned to limit pivoting of each blade mount about the respective blade mount pivot axis.

2. The ice removal blade assembly of claim 1, wherein, the suspension member is movable generally vertically relative to the support member so that the suspension pivot axis is movable generally vertically.

3. The ice removal blade assembly of claim 2, wherein:
- the suspension member defines a slot extending generally vertically; and
- the suspension member has a pivot displaceable along the slot.

4. The ice removal blade assembly of claim 1, further comprising a suspension limiter connected to the support member, the suspension limiter being configured to limit pivoting of the suspension member relative to the support member.

5. The ice removal blade assembly of claim 4, wherein the suspension limiter is connected to an upper portion of the support member.

6. The ice removal blade assembly of claim 4, wherein:
- the suspension limiter has a first lateral end and a second lateral end; and
- the first and second lateral ends are positioned to abut the suspension member to limit pivoting of the suspension member relative to the support member in both rotation directions about the suspension pivot axis.

7. The ice removal blade assembly of claim 6, wherein the suspension limiter is a leaf spring.

8. The ice removal blade assembly of claim 1, wherein, for each blade mount of the plurality of blade mounts, two of the abutments are positioned to limit pivoting of the blade mount.

9. The ice removal blade assembly of claim 1, wherein each blade mount of the plurality of blade mounts is generally rectangular.

10. A snow removal vehicle comprising:
- a snow plow; and
- the ice removal blade assembly of claim 1, the ice removal blade assembly being affixed to the snow plow.

11. An ice removal blade assembly for affixing to a snow plow of a vehicle, comprising:
- a suspension member configured to be operatively and movably connected to the snow plow of the vehicle;
- a plurality of blade mounts pivotably connected to the suspension member, the blade mounts being laterally spaced from one another; and
- a plurality of removable blade members affixed to respectives ones of the blade mounts, each removable blade member of the plurality of removable blade members having a lower cutting edge configured to scrape ice on a ground surface on which the vehicle travels, each removable blade member of the plurality of removable blade members being:
  - pivotable relative to the suspension member about a respective blade pivot axis; and
  - movable together with the suspension member relative to the snow plow of the vehicle,
- wherein the suspension member comprises a plurality of abutments projecting outwardly from an outer surface of the suspension member, the abutments being positioned to limit pivoting of each blade member about the respective blade pivot axis.

12. The ice removal blade assembly of claim 11, wherein:
- the suspension member is configured to be pivotable relative to the snow plow of the vehicle about a suspension pivot axis extending generally parallel to the blade pivot axes; and
- each removable blade member of the plurality of removable blade members is pivotable together with the suspension member about the suspension pivot axis.

13. The ice removal blade assembly of claim 11, wherein:
- the suspension member is configured to be translated generally vertically relative to the snow plow of the vehicle; and
- each removal blade member of the plurality of removable blade members is translated together with the suspension member generally vertically relative to the snow plow of the vehicle.

14. The ice removal blade assembly of claim 11, further comprising:
- a support member configured to be affixed to the snow plow of the vehicle, the suspension member being movably connected to the support member.

* * * * *